US011027180B2

(12) United States Patent
Roser

(10) Patent No.: US 11,027,180 B2
(45) **Date of Patent: *Jun. 8, 2021**

(54) ASYMMETRIC BASKETBALL NET TO SUPPORT BALL RETURN

(71) Applicant: Mark Costin Roser, Hebron, CT (US)

(72) Inventor: Mark Costin Roser, Hebron, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/400,508

(22) Filed: May 1, 2019

(65) Prior Publication Data

US 2019/0255406 A1 Aug. 22, 2019

Related U.S. Application Data

(63) Continuation of application No. 14/474,201, filed on Sep. 1, 2014, now Pat. No. 10,315,084.

(60) Provisional application No. 61/872,145, filed on Aug. 30, 2013.

(51) Int. Cl.
*A63B 63/08* (2006.01)
*A63B 63/00* (2006.01)

(52) U.S. Cl.
CPC ..... *A63B 63/083* (2013.01); *A63B 2063/001* (2013.01); *A63B 2209/00* (2013.01)

(58) Field of Classification Search
CPC ..... A63B 63/083; A63B 2209/00; A63B 2063/001
USPC ..... 473/433, 485
See application file for complete search history.

(56) References Cited

U.S. PATENT DOCUMENTS 2,199,609 A * 5/1940 Bennett ..... A63B 63/083 473/485
2,579,312 A * 12/1951 Garvey ..... A63B 63/083 473/489
3,109,647 A * 11/1963 Austin ..... A63B 63/083 473/485
3,173,687 A * 3/1965 Hair ..... A63B 63/083 473/449
3,313,539 A * 4/1967 Michael ..... A63B 63/083 473/485
3,945,638 A * 3/1976 Luebkeman ..... A63B 63/083 473/433
D271,508 S * 11/1983 McGregor ..... D21/704
4,579,339 A * 4/1986 Grimm ..... A63B 63/083 473/433
4,720,101 A * 1/1988 Farkas, Jr. ..... A63B 63/08 473/433

(Continued)

OTHER PUBLICATIONS

Webpage download, vintagetoys 1972, 1972, www.vintagetoys.com/toys/classified/796, 2 pages.

*Primary Examiner* — Jeffrey S Vanderveen
(74) *Attorney, Agent, or Firm* — Ryan, Mason & Lewis, LLP

(57) ABSTRACT

The present invention is a basketball net designed to facilitate preferred directional momentum to an exiting basketball. The basketball net is designed and constructed in a manner such that the basketball exiting the net has desired exit-trajectory and rotational spin. The present invention enables the basketball leaving the net to return towards the preferred direction, which is, field of play instead of an undefined random direction. The asymmetry is induced by either substituting existing cord segments with those having elastomeric properties, or surface treatment on internal face of the net at particular sections so as to create frictional differentiation.

13 Claims, 15 Drawing Sheets

(56) References Cited

U.S. PATENT DOCUMENTS 4,896,882 A * 1/1990 Coleman ..... A63B 63/083 473/433
4,915,380 A * 4/1990 Ackerman ..... A63B 63/083 473/435
4,957,289 A * 9/1990 Kotlarz ..... A63B 63/083 473/433
5,098,090 A * 3/1992 Juhl ..... A63B 63/083 473/433
5,184,814 A * 2/1993 Manning ..... A63B 63/083 473/433
5,348,290 A * 9/1994 Matherne ..... A63B 63/083 473/433
5,382,017 A * 1/1995 Pippert ..... A63B 63/083 473/433
5,443,258 A * 8/1995 Kinsella ..... A63B 63/083 473/433
5,458,325 A * 10/1995 Klein ..... A63B 63/083 473/485
D367,690 S * 3/1996 Jimick ..... D21/703
5,735,760 A * 4/1998 Brewer ..... A63B 63/083 473/485
5,779,569 A * 7/1998 Townsend ..... A63B 63/083 473/432
6,746,349 B2 * 6/2004 Neiberger ..... A63B 63/083 473/485
7,008,337 B2 * 3/2006 Kershaw ..... A63B 63/083 473/433
7,491,140 B2 * 2/2009 DeGray ..... A63B 63/083 473/433
2002/0119843 A1 * 8/2002 Yu ..... A63B 63/083 473/485
2005/0221921 A1 * 10/2005 Beane ..... A63B 69/0071 473/485
2007/0010357 A1 * 1/2007 Matthew ..... A63B 59/20 473/513
2007/0060420 A1 * 3/2007 Bradford ..... A63B 63/083 473/447
2015/0065276 A1 * 3/2015 Roser ..... A63B 63/083 473/485

* cited by examiner

ASYMMETRIC BASKETBALL NET TO SUPPORT BALL RETURN

CROSS REFERENCE TO RELATED APPLICATION(S)

This application is a continuation of U.S. patent application Ser. No. 14/474,201, filed Sep. 1, 2014, which claims priority to U.S. Provisional Patent Application Ser. No. 61/872,145, filed on Aug. 30, 2013, both of which are incorporated by reference herein.

FIELD

The present invention relates to a basketball net designed to facilitate preferred directional momentum to an exiting basketball. More particularly, the present invention relates to a basketball net designed and constructed in a manner such that the basketball exiting the net has a desired exit-trajectory and rotational spin. The present invention enables the basketball leaving the net to return towards the preferred direction, which is, towards the field of play instead of an undefined random direction.

BACKGROUND

Traditional or state of the art basketball nets have symmetric conical shape and are kept in place by various means. While playing the game, the basketball is thrown towards the net to make it pass through the same. The players then strive to re-gain control of the ball again. Now, during this process the basketball can exit through the bottom of the net at different angles depending upon the route which basketball travels through the hoop or rim. For instance, basketballs falling straight down through the center of the rim fall vertically downward when exiting the net. Alternatively, if the basketball falls through the hoop slightly off-center, the basketball may touch the hoop or even the board before falling through the net. The basketball can then bounce forward, backward, to the left, or to the right after falling through the net. If the basketball constantly exits the basketball net at different angles, a basketball player must continuously retrieve the basketball from different locations. Such a situation demands extra effort and may require additional attention particularly when the basketball court is located near hills, pedestrians, traffic or undesirable locations where the basketball may bounce after exiting the basketball net. This additional effort and attention deters overall enjoyment of the game and increases the risk of injury to players and bystanders.

There have been a number of inventions that are designed to address the problem. U.S. Pat. No. 7,008,337 describes a basketball return apparatus formed of an injection molded device which is formed as a resilient deflector including a spine extending the length of the device. The spine has a pair of upper and lower wings which are located behind a net suspended from a hoop rim.

Similarly, U.S. Pat. No. 5,382,017 discloses multiple elongated flexible channel straps each having a top end that attaches to a basketball rim and bottom end. The slope of the channel straps control the angle and speed in which a basketball exists the net.

U.S. Pat. No. 6,746,349 has disclosed basketball net having an integrally formed resilient net-like body of a generally tapered configuration. A connected undulating central waist portion of the body is defined by a series of oppositely disposed upper and lower cutouts to facilitate limited stretching of the net-like body about its waist.

Mechanical devices disclosed in prior art rely upon rigid or semi-rigid elements, collectively referred to as "chute" type of device, to re-direct the ball after leaving the hoop. However, these do not see universal adoption by players and hoop owners. Rigid chute devices are gaining popularity among players as a way to facilitate ball return, but such devices have multiple drawbacks. For instance, their appearance does not support the look and feel of a competitive game—but implies a level of amateurism or incompetence—similar to how a set of training wheels impacts the look of a bike. They are costly but look childish and unprofessional. Most of the times, chutes do not get along with the aesthetic and historical beauty of the game. Not only that, chutes can interfere with jump shots and slam dunk shots—creating an unwanted and unsafe obstruction to play. Chutes are not admired as they interfere with the competitive nature of the game, imparting unwanted rebound to balls shot below the rim that would otherwise not be impeded by the net alone. Accordingly, there is requirement of a professional, aesthetic and effective design of basketball net that directs the basketball in a preferred direction while exiting the net. There is requirement of a design which is acceptable to the professionals and doesn't interfere with the beauty of the game while achieving the desired returning function.

SUMMARY

The present invention is a basketball net designed to facilitate preferred directional momentum to an exiting basketball. The basketball net is designed and constructed in a manner such that the basketball exiting the net has desired exit-trajectory and rotational spin. The present invention enables the basketball leaving the net to return towards the preferred direction, which is, field of play instead of an undefined random direction.

Asymmetry in the design of the basketball net is induced to create a front facing net direction and an aft facing net direction as well as two sides. The basketball net is asymmetric in manner that at least one of construction, design, roughness, continuity of rope, or addition of elements is different in different parts of the basketball net geometry. In current designs, the V shapes at the upper end of net are the result of having a single loop attached to a hoop anchor creating an inverted V. In an embodiment, asymmetry is induced by increasing the number of primary connectors to the hoop. Inverted V shapes adjacent to each other allows for momentum of the ball through the hoop and initial net contact to establish the trajectory as the ball leaves the net. Managing the sway and rebound in the fore or aft directions can influence exit trajectory of the ball towards the forward direction. Increasing the number of attachments to the hoop anchors results in range of motion limited more to one direction than another through increased triangulation.

In another embodiment, frictional asymmetry in the internal net surface is induced. Increased friction on the aft segments compared to the front segments slows the trajectory on the side of the ball dropping through the net, allowing the front face of the ball to accelerate faster, thereby inducing rotational spin into the ball. Though this spin and the differential friction doesn't necessarily alter the ball's exit trajectory, yet upon landing, the spin induces a bounce that will alter the trajectory of the ball such that it has more force orienting it to move towards the center of the court.

In traditional construction, basketball nets are circular at their top as well as their bottom. In an embodiment of the present invention, geometrical asymmetry, especially at the bottom, is induced. The asymmetric shape, like that of an egg, is employed so as to provide additional constriction and resistance to passage through the aft of the net as compared to the fore of the net. In such a manner, a favored trajectory is induced due to reduced forward constriction. In addition to that is induced a rotational spin due of increase restriction based friction at the aft side of the ball, creating a spin which imparts a bounce toward the center court.

In an embodiment of the present invention, asymmetric rope material of preferably stiffer sections in specific parts of the net weave is used. The asymmetry imparts differential elasticity in overall net geometry, resulting in a forward oriented trajectory of ball while exiting to assist in returning the ball to play.

Accordingly, it is an object of the invention to provide a design and construction of a basketball net to facilitate preferred directional momentum to an exiting basketball.

Another object of the invention is to obviate use of traditional chute like devices and provide asymmetric construction to achieve desired results, while maintaining the safety, beauty and aesthetic appearance similar if not identical to traditional net designs.

It is yet another object of the invention to provide a basketball net with inbuilt property of facilitating ball return.

The above and yet other objects and advantages of the present invention will become apparent from the hereinafter set forth brief description of the drawings, detailed description of the invention, and claims appended herewith.

DETAILED DESCRIPTION

The present disclosure will now be described more fully with reference to the figures in which various embodiments of the present invention are shown. The subject matter of this disclosure may, however, be embodied in many different forms and should not be construed as being limited to the embodiments set forth herein.

Figure 1A:
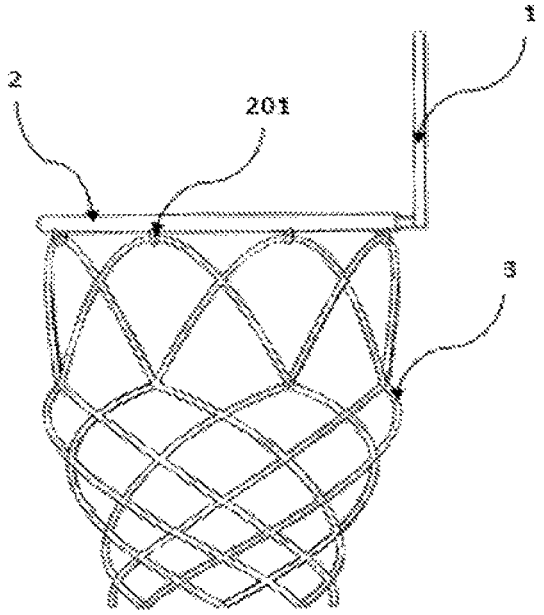
FIG. 1*a* shows a conventional basketball net.

Referring to FIG. 1*a*, conventional basketball net assembly is shown as a woven net system in a manner consistent with the conventional basketball goal system. The basketball goal includes a backboard 1, which supports a basketball goal rim 2 and conventional rams or anchors 201, used to attach basketball net 3 to the rim. The woven net system includes fore, aft, Left-side and Right-side portions with respect to the backboard and a plurality of segments woven together to form the net system. As shown in FIG. 1*a*, the net system suspends under the rams and tapers down to form a conical structure with a broader upper end and a narrower lower end. The basketball entering the broader upper end exits through the lower end.

Figure 1B:
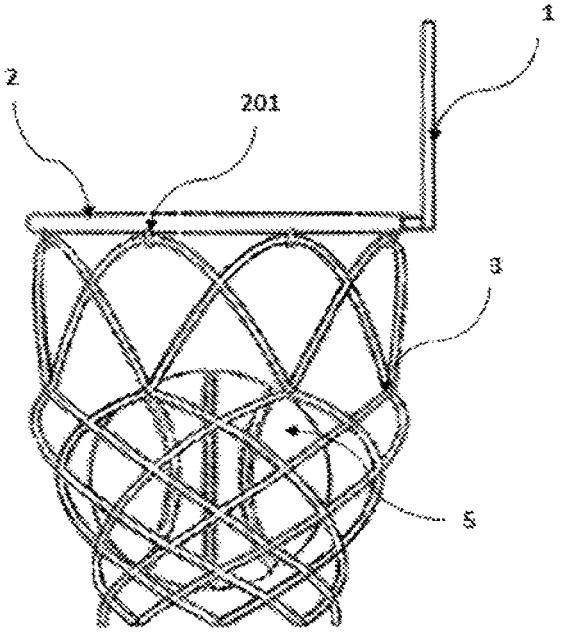
FIG. 1*b* shows trajectory of a basketball through state of the art net.

Referring to FIG. 1*b*, a basketball may exit through the lower end of a net system in any random direction depending on the route which basketball travels through the hoop or rim.

Figure 2:
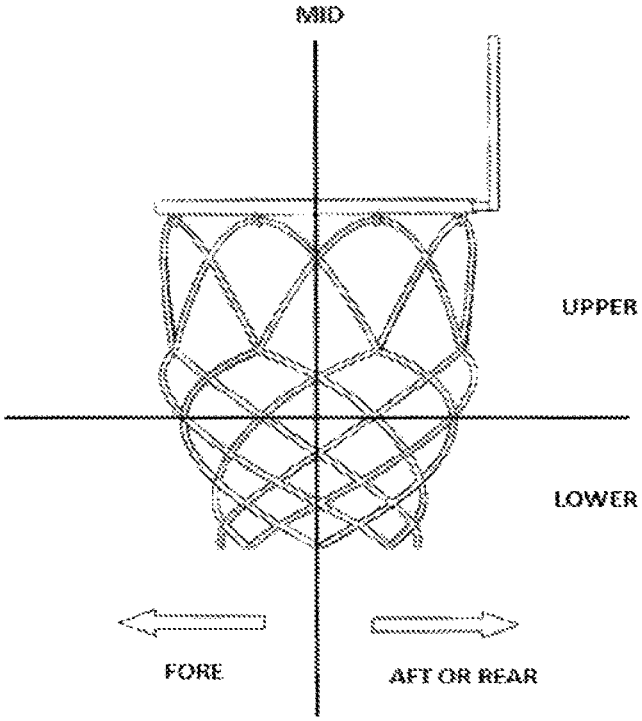
FIG. 2 shows various identified sections of the basketball net according to the present invention.

Referring to FIG. 2 a basketball net assembly has fore and aft sections with respect to the attachment to the board. The upper and lower sections are identified with respect to the attachment to the hoop.

Figure 3A:
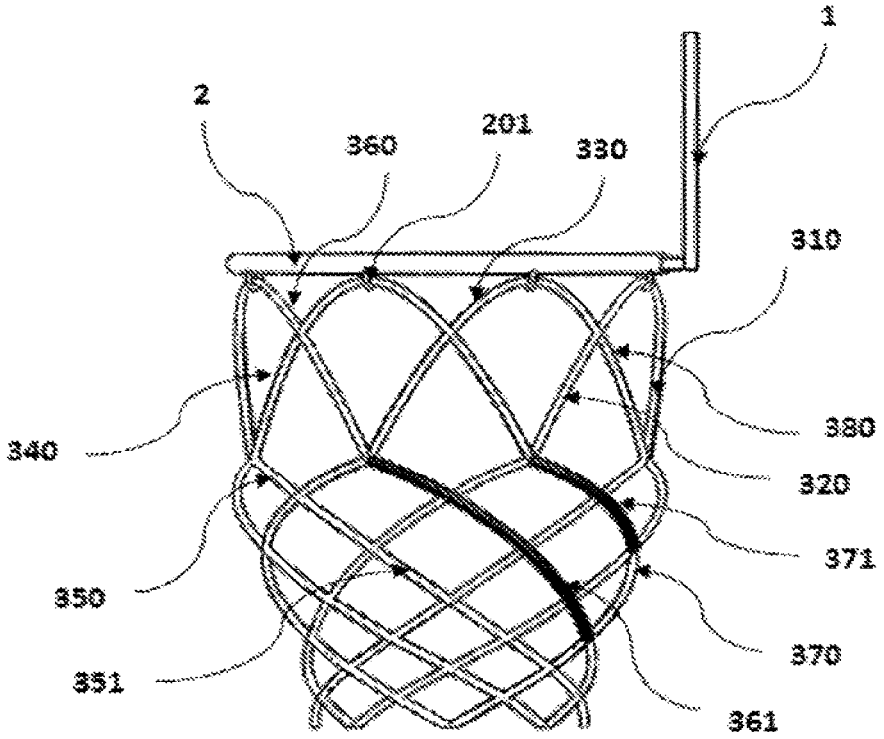
FIG. 3*a* shows asymmetric net assembly according to an embodiment of the invention.

Referring to FIG. 3*a* asymmetric net assembly according to an embodiment of the invention has selective segments 361, 371 with different elastomeric properties from rest of the segments of the net system. In a further modification of this embodiment, the selected segment 371 has higher spring rate that that of selected segment 361.

Figure 3B:
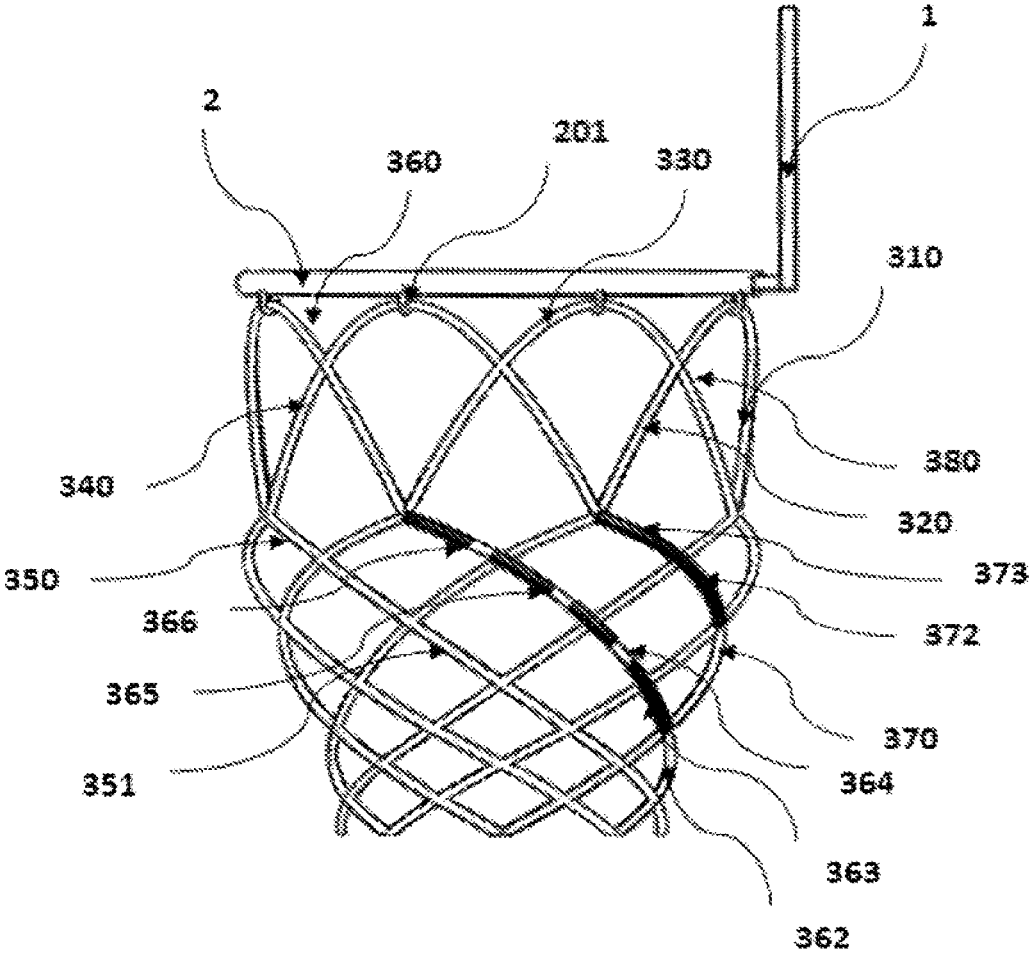
FIG. 3*b* shows asymmetric net assembly having segments of differing properties according to an embodiment of the invention.

Referring to FIG. 3*b* asymmetric net assembly according to an embodiment of the invention has selective segments 373, 372, 366, 365, 364, 363 with different elastomeric properties from rest of the segments of the net system. In a further modification of this embodiment, the selected segment 372 has higher spring rate that that of selected segment 373, and selected segment 364 has higher spring rate that that of selected segment 365 and 366. The asymmetric net assembly according to preferred embodiment of the invention has selective segments which traverse rearward downward, and are anchored on the sides of the rim 2 near to midpoint when viewed from the side. They are symmetrical and represent both Left and Right sides when viewed from the front. The said segments have gradually varying rate of spring wherein segment towards rear have higher spring rates than segments towards middle which in turn have higher rate of spring then segments towards front. In further modification, some or entire spring segment lengths may also be shortened as compared to similar segments by 1 to 10%. The selective segments 373, 372 are at least 1% shorter as compared to other segments. As shown in FIG. 6, cords are secured to the rim 2 with additional anchors 202 so as to limit the amount by which cords are able to slip through the rams thereby providing a stable anchor for the tension within the spring elements. In a further modification of the preferred embodiment the selective segments 373, 372, 366, 365, 364, 363 are substituted with 6 mm bungee cord.

Figure 4A:
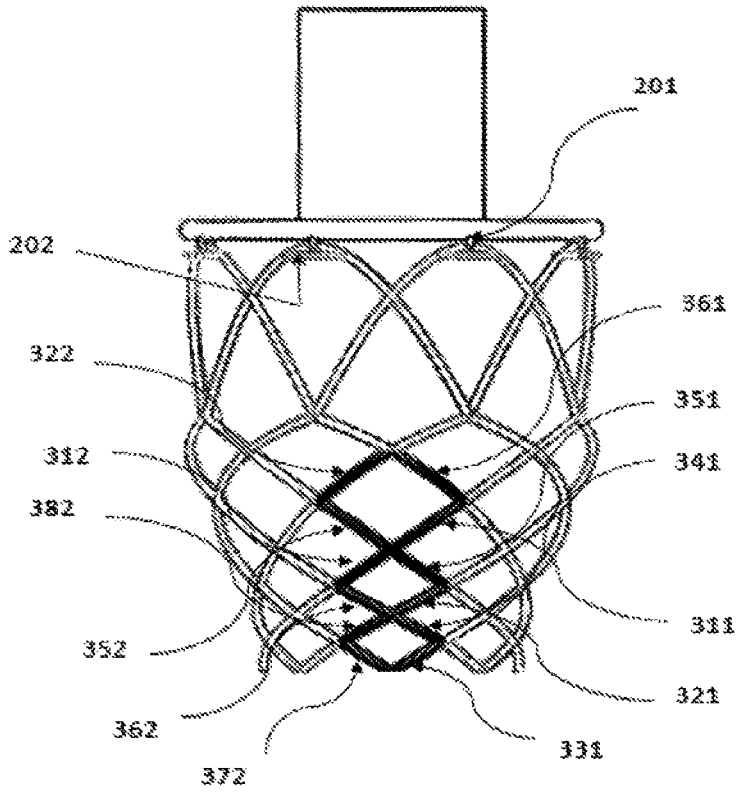
FIG. 4*a* shows asymmetric net assembly having front lower segments with varied elasticity.

Referring to FIG. 4*a* asymmetric net assembly according to an embodiment of the invention has selective segments

31-36, 31'-36' in lower front of net system with lower spring rates. In a further modification of this embodiment, the loops formed by selective segments 31-31' to 36-36' are modified to make them 5% longer than comparable segments which results into a larger exit pathway for balls to escape with lower resistance. Such modifications in the length result in an oval or egg shaped lower end of the net where the narrower rear end of the exit resists the ball from going rearwards and broader front end of exit facilitates movement of exiting ball towards the field.

Figure 4B:
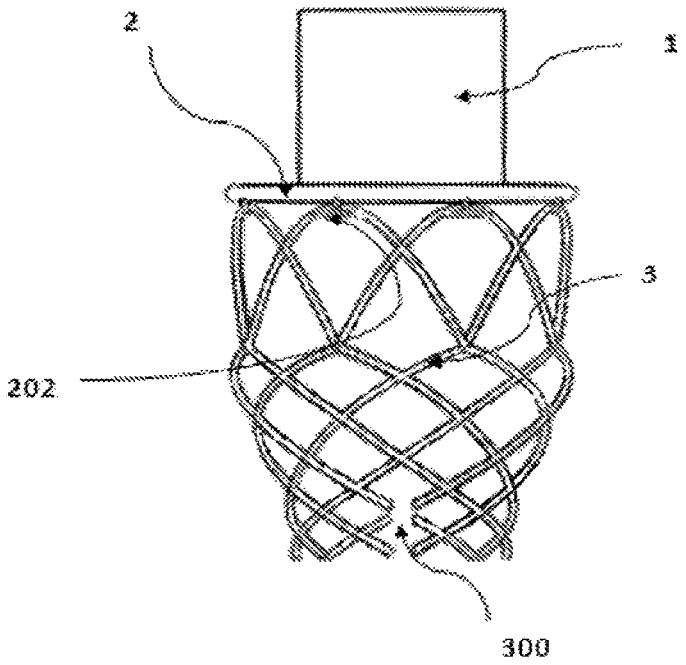
FIG. 4*b* shows asymmetric net assembly having front lower segments incised.

Referring to FIG. 4*b* asymmetric net assembly according to an embodiment of the invention has selective segments 300 in lower front of net system sliced open resulting into free flow of the basketball through the region especially when the ball is moving toward the field of play. In further modification of this embodiment, the sliced segments may be stiffened by means of plastic, starches or other state of the art method to maintain the familiar geometric net shape and minimize departure from traditional aesthetics.

Figure 4C:
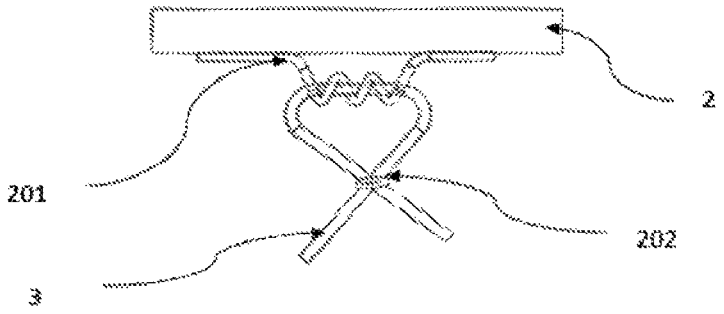
FIG. 4*c* shows additional anchor according to an embodiment of the invention.

Referring to FIG. 4*c*, additional support anchor 202 is placed to prevent net cord 3 from slipping through ram 201.

Figure 5A:
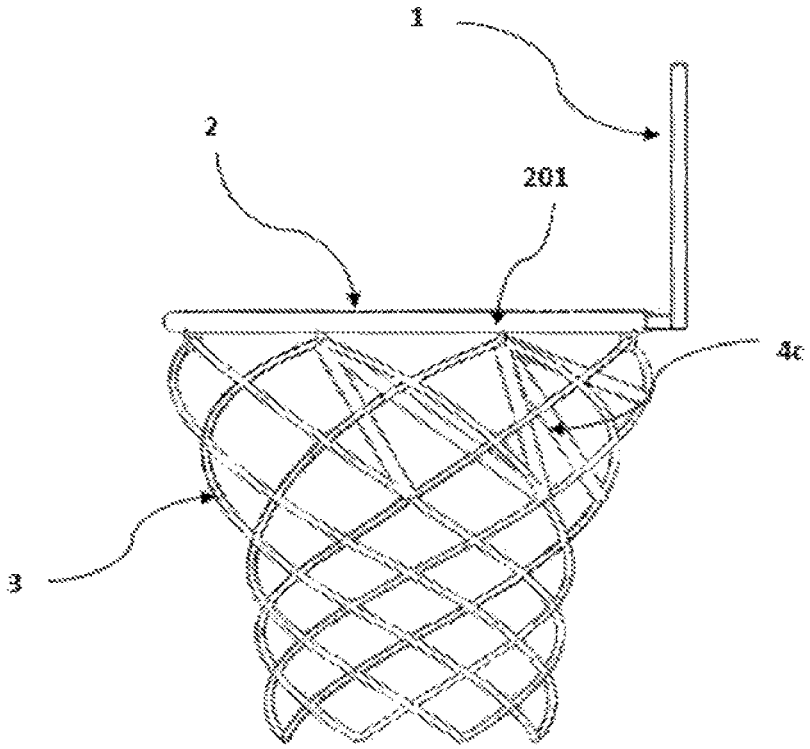
FIG. 5*a* shows asymmetric net assembly having support elements according to an embodiment of the invention.
Figure 5B:
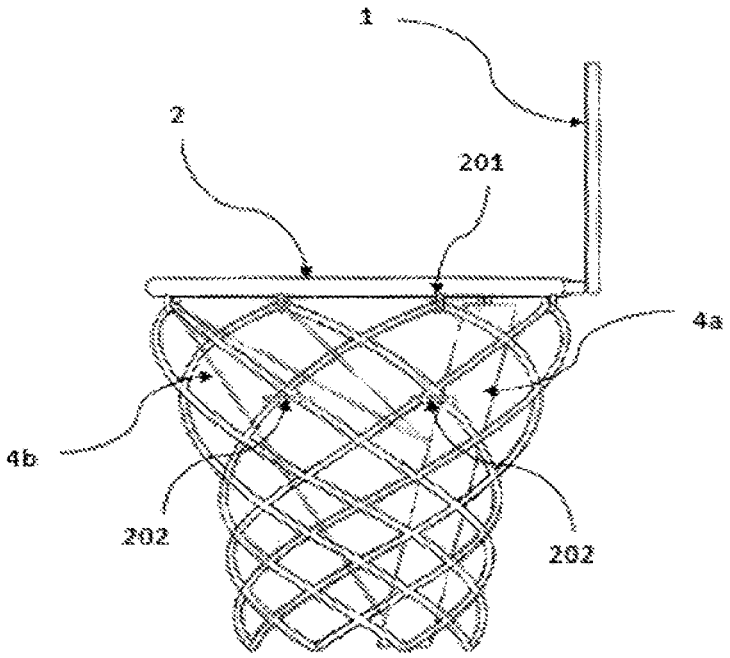
FIG. 5*b* shows another asymmetric net assembly having support elements according to an embodiment of the invention.

Referring to FIG. 5*a* asymmetric net assembly according to an embodiment of the invention has net support elements 4*c* attached to the rim 2 at one end and mid rear segments of the net system. In a further modification of the embodiment, shown in FIG. 5*b*, the invention has an additional flat and rigid element 4*a* kept suspended at mid-rear slant position with the means of support elements 4*b* attached to the rim 2 at one end and to the element 4*a* at the other.

Figure 6A:
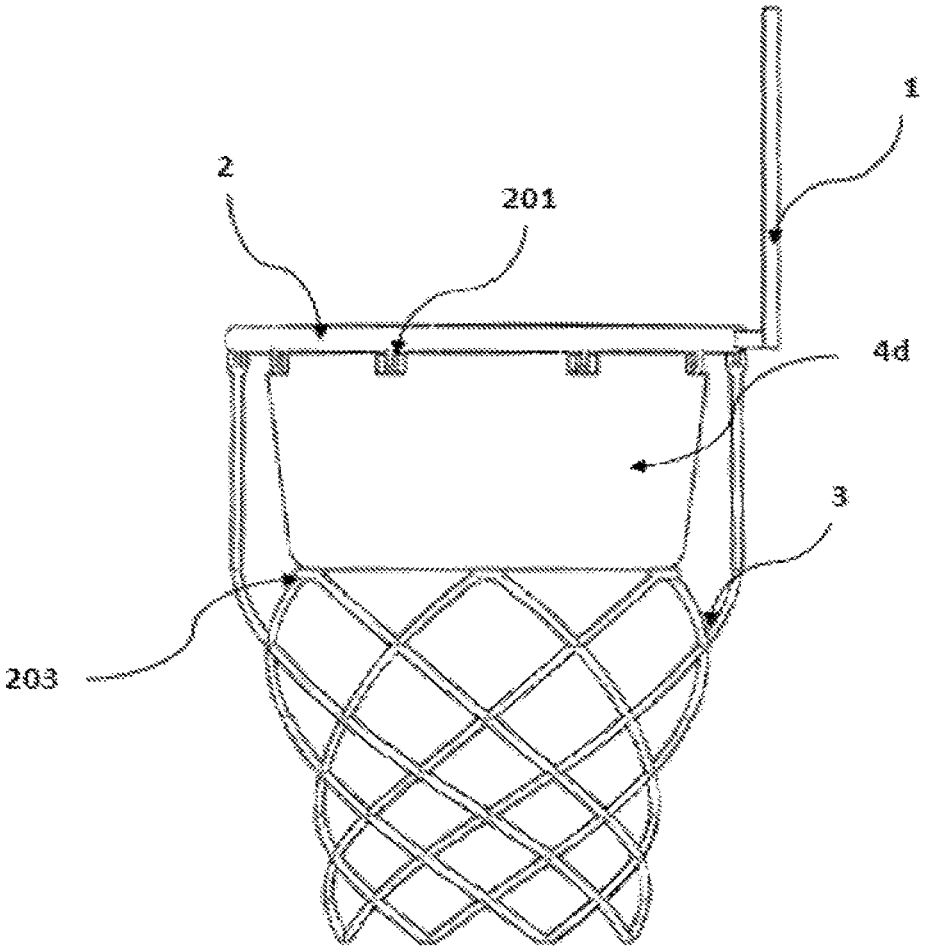
FIG. 6*a* shows another asymmetric net assembly having support elements according to an embodiment of the invention.

Referring to FIG. 6*a* asymmetric net assembly according to an embodiment of the invention has a shield element 4*d* which may be a thermo-formed rubber trapezoid panel (or constructed of other flat material), is a replacement element for several line segments of the net. The shield has openings 204 on upper end which may be oval or rectangular and through which the horns 201 can be passed through to establish the means by which the shield is suspended from the rim 2. The cord segments of net anchor at the bottom of the shield by means of additional horns 203. The shield is designed to stretch down and to the rear and not to stretch to the front, thus helping to re-direct balls entering the net directly from the field of play without first bouncing off the back board.

Figure 6B:
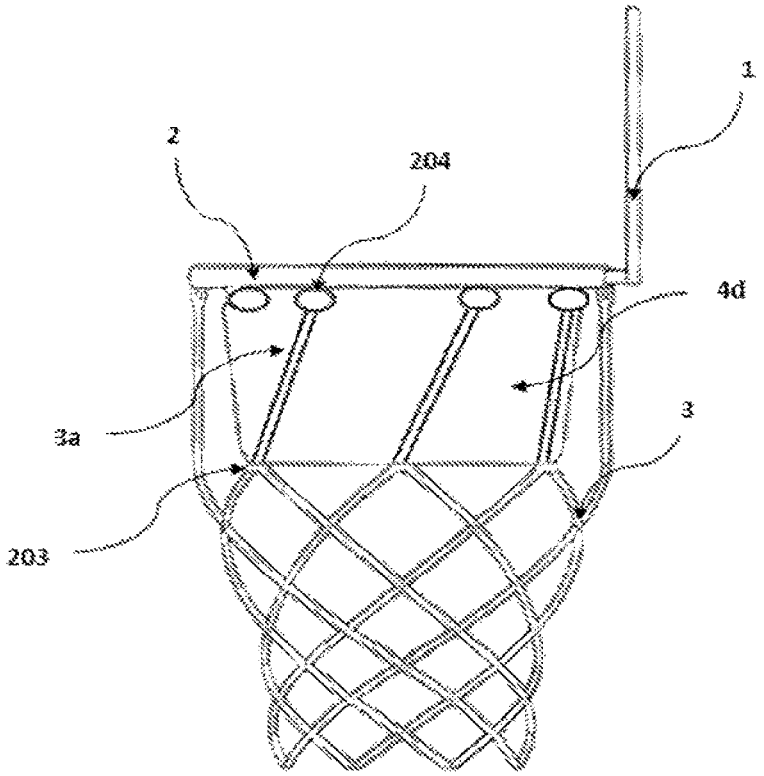
FIG. 6*b* shows another asymmetric net assembly having support elements according to an embodiment of the invention.

Referring to FIG. 6*b*, in an alternate embodiment, at least two cord segments 3*a* in middle or rear section of net immediately below the rim are molded into the rubber in a manner that it is unable to stretch in the forward direction, but can stretch perpendicularly to the embedded segments, thus any downward force would allow the bottom of the shield 4*d* to stretch downward and rearward. The surface area of the shield 4*d* also allows the net to be 'branded' with a logo. The cord segments of net anchor at the bottom of the shield by means of additional horns 203. The shield may be used independently or in any combination of other elements described in other embodiments of present invention.

Figure 7:
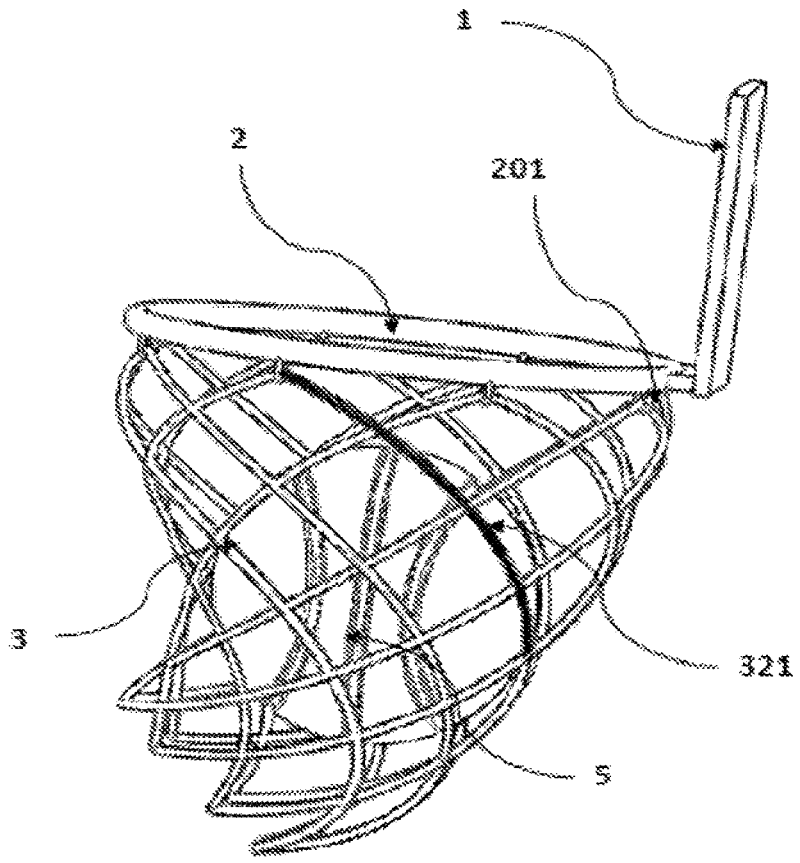
FIG. 7 shows a segment of the asymmetric net assembly anchored to the hoop of the net.

Referring to FIG. 7, the basketball 5 exiting from the lower end of the net has preferred trajectory resulting from the asymmetry of the net by virtue of elastomeric segment 321 in middle section traversing rearwards. The differential elasticity in the segment of the net assembly imparts downwardly forward momentum towards the field of play.

Figure 8A:
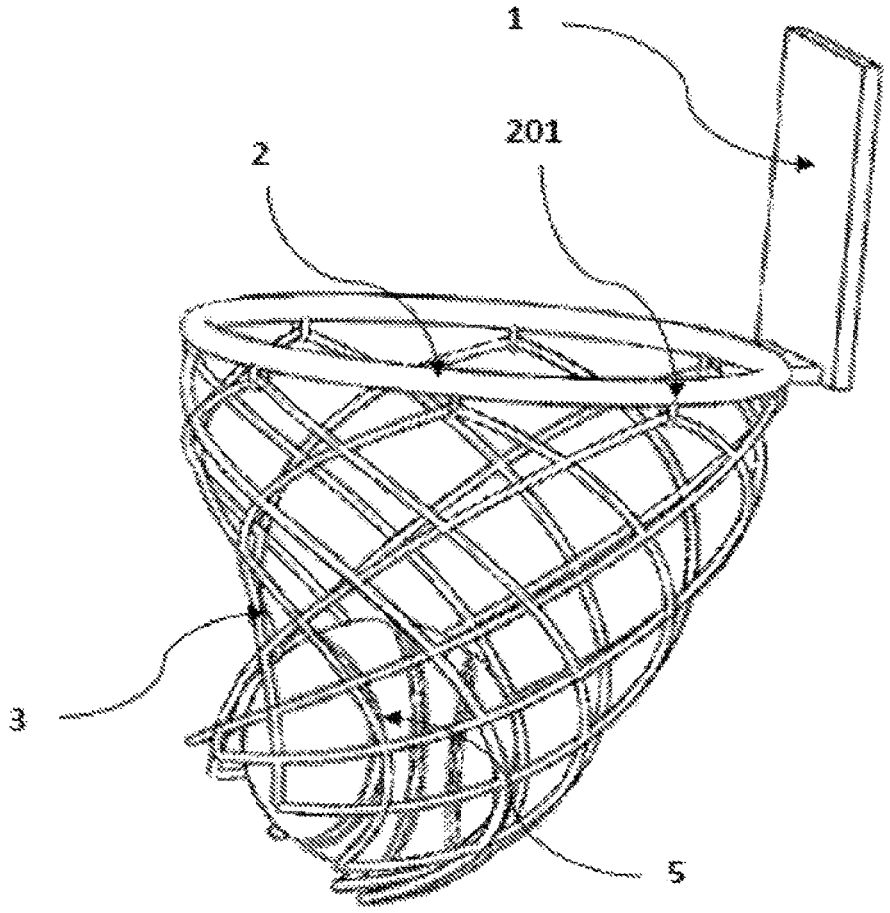
FIG. 8*a* shows the resultant trajectory of a basketball through the asymmetric net.

Referring to FIG. 8*a*, the basketball exiting from the lower end of the net has preferred trajectory resulting from the asymmetry of the net. The differential elasticity in various segments of the net assembly imparts downwardly forward momentum towards the field of play.

Figure 8B:
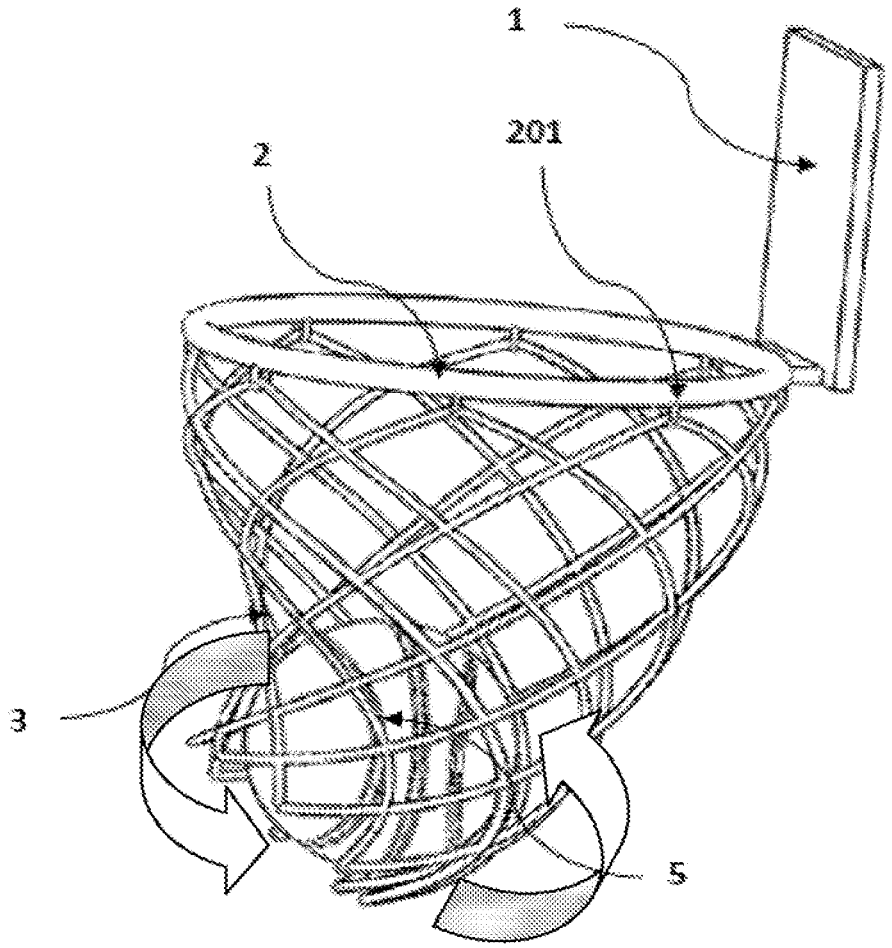
FIG. 8*b* shows the resultant momentum of a basketball through the asymmetric net.

Referring to FIG. 8*b*, rotational momentum of the basketball is induced by an asymmetric net assembly in a desired manner. The surface of the ball facing the rear of the net is decelerated by increased friction and restriction while the surface of the ball facing front of the net is less restricted and experiences less friction allowing greater acceleration, inducing spin in the ball that will translate to horizontal momentum towards the field of play upon bouncing on the ground.

It is prevalent from the foregoing embodiments and drawings that the basketball net assembly has constructional asymmetry wherein the fore and aft regions of the net differ from each other in spring rate, or elongation, or constructional elements, or weave pattern, or surface patterns and configuration. In a preferred embodiment of the present invention, the asymmetric net has segments in aft of the mid-line when viewed from the side designed to have a higher coefficient of friction on the surfaces that will likely contact the ball as it passes through the net, while segments fore of the mid-line when viewed from the side are designed to have a lower coefficient of friction on the surfaces that will likely contact the ball as it passes through the net. The coefficient of friction may be modified in any number of ways or combinations of ways. These may include spraying with lubricants or state of the art agents to confer a surface treatment. Use of threads in the construction of the segments that have different friction characteristics (e.g., including the use of a latex cord as one of the threads of the weave of a given rope to increase friction) is also workable. In an alternate embodiment of the present invention, a hybrid rope is used to form the net assembly. The rope allows limited stretch. Elastic segments are constructed that have a limited amount of stretch, after which it acts like rope, as opposed to having bungee cord only which has the ability to increase its length by more than 300%. State of the art material of basketball nets is hollow, with a tube style of weave with the appearance of broad strong rope. However, it is actually flexible, hollow, soft and light. This state of the art material with a bungee cord installed within the hollow thus making a hybrid rope imparts desirable limited stretch. Thus, the segment is allowed to have 15 to 35% stretch before the line reaches its taught state and behaves conventionally.

In an alternate embodiment, the foregoing features may be integrated together. For instance, the fore segments being weak spring members as well as elongated resulting into minimal force return together with the bottom loops separated to allow passage with no force return. The combination of high and low friction coefficients may be applied in the assembly to have a cumulative effect on the overall momentum of the basketball exiting through the net.

In an alternate embodiment, the upper-fore section and lower-rear section have higher spring rates as compared to that of lower-fore section.

To achieve the desired asymmetry, spring effect has been induced in various embodiments explained in the foregoing paragraphs. Such spring effect may be introduced in a number of ways. Non-limiting examples include:

substitution of the traditional line/rope with spring material; or modification of the traditional line/rope with spring material, for example, inserting bungee cord in the hollow of tubular weave line; or insertion of spring elements within the path of the traditional line/rope, for example—inserting a bungee or a spring or a shaped rubber loop; or addition of spring elements to supplement the traditional line segments, for example as a kit with anchors and elastic bungee members to allow rapid attachment and detachment when a user is playing on a public court and wishes the device to be easily removed where it can be kept safe when not in use; or insertion of spring elements at the juncture of traditional line/rope, for example instead of knotting 2 strands of the traditional line rope together to join them and create 4 emanating segments, a device could be created that acts as an anchor for 4 individual strands—for example a rubber ring or other device to enable this anchoring device to impart spring in either or both axes of line passage.

The essence of the present invention is to make a basketball net asymmetric in physical, mechanical or both properties. This can also be achieved in already existing nets by means of kits which include removable segments and other accessories for customization. This is advantageous in the situation at public courts, where players may wish to install their kit upon arrival at the court and remove the kit upon departure.

Given the fact that the preferred direction of ball return is towards field of play, the design of the net is symmetrical about the mid-line when viewed from the center court of the field of play. These left and right sides are symmetrical. Descriptions in this application describe only one side as a means of clarity of writing—and should not be assumed as a one-sided or limited solution.

To address safety concerns, the present invention further provides multiple ways in which elastic members may be designed in order to limit their stretch. For instance, this may be achieved through the use of coaxial elastic within the hollow core of woven line. By limiting the extent to which the elastic members can stretch before reaching pre-defined limits safety levels as compared to a traditional net are maintained. In addition to the same, other means may also be employed to restrict people from hanging on the net, such as a tighter mesh weave to overlay all or part of the net such that one cannot place their fingers through the weave.

In preferred embodiments, segments of varying mechanical qualities may be adorned with different colors to accentuate the net and highlight its performance characteristics and accentuate the brand image. Segments may also be modified with various means to change their acoustic quality, to enable a player to better hear the sound of the ball passing through the net and interpret the location and trajectory of the shot based upon the acoustic qualities of the ball interacting with the modified net.

What is claimed is:

1. An asymmetric basketball net assembly comprising:

an asymmetric net comprising at least one cord, wherein the at least one cord comprises a plurality of segments;

said asymmetric net having an upper end and a lower end, wherein the upper end is broader than the lower end;

said asymmetric net having at least one fore section comprising one or more of the plurality of segments, at least one rear section comprising one or more of the plurality of segments, and at least two side sections each comprising one or more of the plurality of segments;

wherein at least a portion of the one or more segments in each of the at least two side sections have varying elasticity, wherein one or more of the segments more proximate to the at least one fore section are less elastic than one or more of the segments more proximate to the at least one rear section; and wherein at least one of the at least two side sections comprises a panel of solid material, wherein at least a portion of two or more of the plurality of segments contained within the given side section are molded into at least a portion of the solid material.

2. The asymmetric basketball net assembly as claimed in claim 1, wherein the panel of solid material comprises at least one of one or more rubber materials and one or more plastic materials.

3. The asymmetric basketball net assembly as claimed in claim 1, wherein the panel of solid material comprises at least one thermo-formed material.

4. The asymmetric basketball net assembly as claimed in claim 1, wherein the panel of solid material is attachable to and detachable from the asymmetric net.

5. An asymmetric basketball net assembly comprising:

an asymmetric net comprising at least one cord, wherein the at least one cord comprises a plurality of segments;

said asymmetric net having an upper end and a lower end, wherein the upper end is broader than the lower end;

said asymmetric net having at least one fore section comprising one or more of the plurality of segments, at least one rear section comprising one or more of the plurality of segments, and at least two side sections each comprising one or more of the plurality of segments;

wherein at least a portion of the one or more segments in each of the at least two side sections have varying elasticity, wherein one or more of the segments more proximate to the at least one fore section are less elastic than one or more of the segments more proximate to the at least one rear section; and wherein at least one of the at least two side sections comprises a panel of solid material, wherein the panel of solid material is attachable to and detachable from at least a portion of the asymmetric basketball net assembly.

6. The asymmetric basketball net assembly as claimed in claim 5, wherein the panel of solid material comprises at least one of one or more rubber materials and one or more plastic materials.

7. The asymmetric basketball net assembly as claimed in claim 5, wherein the panel of solid material comprises at least one thermo-formed material.

8. The asymmetric basketball net assembly as claimed in claim 5, wherein at least one of said segments in one or more of the at least one fore section, the at least one rear section, and the at least two side sections differs in one or more surface frictional properties from one or more other segments among the plurality of segments.

9. An asymmetric basketball net assembly comprising:

an asymmetric net comprising at least one cord, wherein the at least one cord comprises a plurality of segments;

said asymmetric net having an upper end and a lower end, wherein the upper end is broader than the lower end;

said asymmetric net having at least one fore section comprising one or more of the plurality of segments, at least one rear section comprising one or more of the plurality of segments, and at least two side sections each comprising one or more of the plurality of segments;

wherein at least one of said segments in a lower portion of the at least one fore section is separated into multiple disconnected sub-segments;

wherein at least a portion of the one or more segments in each of the at least two side sections have varying elasticity, wherein one or more of the segments more proximate to the at least one fore section are less elastic than one or more of the segments more proximate to the at least one rear section; and wherein at least one of the at least two side sections comprises a panel of solid material, wherein at least a portion of two or more of the plurality of segments contained within the given side section are molded into at least a portion of the solid material.

10. The asymmetric basketball net assembly as claimed in claim 9, wherein the panel of solid material comprises at least one of one or more rubber materials and one or more plastic materials.

11. The asymmetric basketball net assembly as claimed in claim 9, wherein the panel of solid material comprises at least one thermo-formed material.

12. The asymmetric basketball net assembly as claimed in claim 9, wherein the panel of solid material is attachable to and detachable from the asymmetric net.

13. The asymmetric basketball net assembly as claimed in claim 9, wherein at least one of said segments in one or more of the at least one fore section, the at least one rear section, and the at least two side sections differs in one or more surface frictional properties from one or more other segments among the plurality of segments.

* * * * *